US007410455B2

(12) United States Patent
Akishev et al.

(10) Patent No.: US 7,410,455 B2
(45) Date of Patent: Aug. 12, 2008

(54) METHOD FOR CURVILINEAR FOLDED STRUCTURE PRODUCTION

(75) Inventors: Niaz Irekovich Akishev, Kazan (RU); Ildus Muhametgaleevich Zakirov, Kazan (RU); Alexandr Vladimirovich Nikitin, Kazan (RU)

(73) Assignees: Airbus, Blagnac (FR); Otkrytoe Aktsionernoe Obschestvo "Kazansky Nauchno-Isledovatelsky Institute Aviatsionnoi Tekhnologii", Kazan (RU)

( * ) Notice: Subject to any disclaimer, the term of this patent is extended or adjusted under 35 U.S.C. 154(b) by 3 days.

(21) Appl. No.: 10/579,539

(22) PCT Filed: Nov. 20, 2003

(86) PCT No.: PCT/RU03/00511

§ 371 (c)(1),
(2), (4) Date: Dec. 6, 2006

(87) PCT Pub. No.: WO2005/049307

PCT Pub. Date: Jun. 2, 2005

(65) Prior Publication Data

US 2007/0080482 A1 Apr. 12, 2007

(51) Int. Cl.
*B31B 1/00* (2006.01)

(52) U.S. Cl. ..... 493/408; 493/463

(58) Field of Classification Search ..... 493/408, 493/463, 480; 428/178, 116, 183, 180
See application file for complete search history.

(56) References Cited

U.S. PATENT DOCUMENTS

| | | | | | |
|---|---|---|---|---|---|
| 1,875,188 | A | * | 8/1932 | Williams | 428/178 |
| 2,561,147 | A | * | 7/1951 | Smith | 449/44 |
| 4,397,902 | A | * | 8/1983 | Resch | 428/119 |
| 5,028,474 | A | | 7/1991 | Czaplicki | |

FOREIGN PATENT DOCUMENTS

| | | |
|---|---|---|
| EP | 0 400 424 | 12/1990 |
| EP | 1 025 983 | 8/2000 |
| GB | 2 123 874 | 2/1984 |

* cited by examiner

*Primary Examiner*—Sameh H. Tawfik
(74) *Attorney, Agent, or Firm*—Oblon, Spivak, McClelland, Maier & Neustadt, P.C.

(57) ABSTRACT

The invention can be defined in its most general form as the method for sheet material corrugation and can be used for production of aircraft curvilinear sandwich panel folded structure light corrugated core. With the aim to broaden the technological capabilities the corrugated blank is compressed from its sides to joining of ridges providing in its lateral section the curvature radius defined by the curvilinear folded structure design parameters and fixed in such condition block is thermally treated for inner stresses relief in the article material whereupon it is stretched to the curvilinear folded structure parameters given.

5 Claims, 3 Drawing Sheets

METHOD FOR CURVILINEAR FOLDED STRUCTURE PRODUCTION

TECHNICAL FIELD

Our invention can be defined in its most general form as a method for sheet material corrugation and can be used for production of curvilinear folded structure light corrugated core as applied to airframe sandwich panels.

BACKGROUND ART

Known is a method for curvilinear folded structure production at geometrical conjunction of the article and the transformable dies wherewith the article is shaped. It includes, at the first stage, placing of sheet blank onto the lower shaping transformable die whereas the similar upper transformable die is placed onto the blank. Equidistantly placed the upper and the lower transformable dies consist of plane shaping elements made in the form of parallelograms; the shaping elements are connected to each other along all the sides with the use of hinges.

At the second stage, when transforming the dies, e.g. with the use of vacuum bag, the upper and the lower transformable dies embedding into the blank change the curvature whereas the blank is put into relief form with crimp design parameters given (V. I. Khaliulin, Technological schemes for sandwich structures production, KSTU, Kazan, 1999.—168 p., p. 128-133.—ISBN 5-7579-0295-7).

The main short-coming of herein-presented method for sheet blank corrugation whereat the curvilinear article is attained is that with the aim to provide the given folded structure curvature defined with the use of mathematical computation are the distance between the upper and the lower transformable dies, the curvature radius required for imparting to the blank before shaping, and the dimensions of transformable dies shaping elements ridges. In addition, geometrical dimensions of the upper and the lower dies have different linear parameters. It results in labor-consuming mutual placement of dies at the first stage of shaping. It is impossible to attain the calculated value of the article curvature at failure to execute the strict geometrical conjunction of the upper and the lower shaping dies.

Known is a method for production of curvilinear corrugated core including the marking-out of protrusions and recesses zigzag lines on the blank development whereat the angles of vertexes are accordingly equal to $2\alpha$ and $2\beta$ whose values are related to definite zigzag corrugated core design parameters, and further bending of blank along the marked-out lines (Inventor's certificate No. 1,785,154 USSR, Int. C1. B 32 B 15/00, Method for production of curvilinear sandwich panel with zigzag corrugated core, Bulletin No. 42 of Nov. 16, 1992). The given method is taken as a prototype.

The main short-coming of herein-presented method is that it is possible to produce folded structures only with longitudinal direction of zigzag crimps, e.g. in direction of cylinder generatrix. Yet, in production, e.g. of aircraft fuselage panels, it is necessary that the core should have lateral direction of crimps and should meet the use requirements for condensate removal from panels inner cavities.

DISCLOSURE OF INVENTION

Our invention has for its object to provide the plane block folded structure curvature owing to shear deformation in ridges planes by applying stresses in its compressed to joining of ridges state with formation of curvature providing the article design parameters given when stretching the structure.

The technical result attained at executing of the claimed invention is the improvement of curvilinear folded structure production quality owing to shaping accuracy increase, broadening of technological capabilities.

The stated technical result is attained by that in the known method for curvilinear folded structure production including sheet blank bending along the bending lines to formation of 3-D relief structure, e.g. on the basis of zigzag crimps,—according to the stated technical solution: the blank is bent and folded to joining of obtained folded structure plane block ridges and is put into the shape of arch owing to shear stress application in the ridges planes providing in its lateral section the curvature radius defined by the given curvilinear folded structure design parameters; fixed in such condition block is thermally treated for inner stresses relief in the folded structure material whereupon the block is stretched to the design parameters given. The thermal treatment of folded structure, e.g. from aramide "NOMEX" paper, is executed under reheat temperature equal to 180-210° C., and the decay time equal to 20-30 minutes.

The undertaken by the applicant state of the art analysis shows that there are no analogs characterized by the combination of the features identical to those of the invention. Therefore, the claimed technical solution satisfies the "novelty" condition of patentability.

The results of retrieval for the known solutions in the given area with the aim to reveal the features identical with distinctions of the claimed technical solution show that its features do not result from the state of the art. From the defined state of the art the applicant managed to reveal no influence of the specified essential features upon the attainment of the stated technical result. The claimed technology, therefore, satisfies the "inventive step" condition of patentability.

BRIEF DESCRIPTION OF DRAWINGS

FIG. 1 is a general view of the curvilinear folded structure, FIG. 2 is a scaled up view A of FIG. 1 (crimp design parameters), FIG. 3 is the development of folded structure on the sheet blank, FIG. 4 presents the ready-made folded structure block compressed to joining of ridges, and FIG. 5 presents the putting of compressed block lateral section into the shape of arch.

The FIGS. 1-4 present the following positions:

1 is the zigzag lines of protrusions, 2 is the zigzag lines of recesses, 3 is the saw-tooth lines.

BEST MODE FOR CARRYING OUT THE INVENTION

Our method is realized in the following way.

Figure 1:
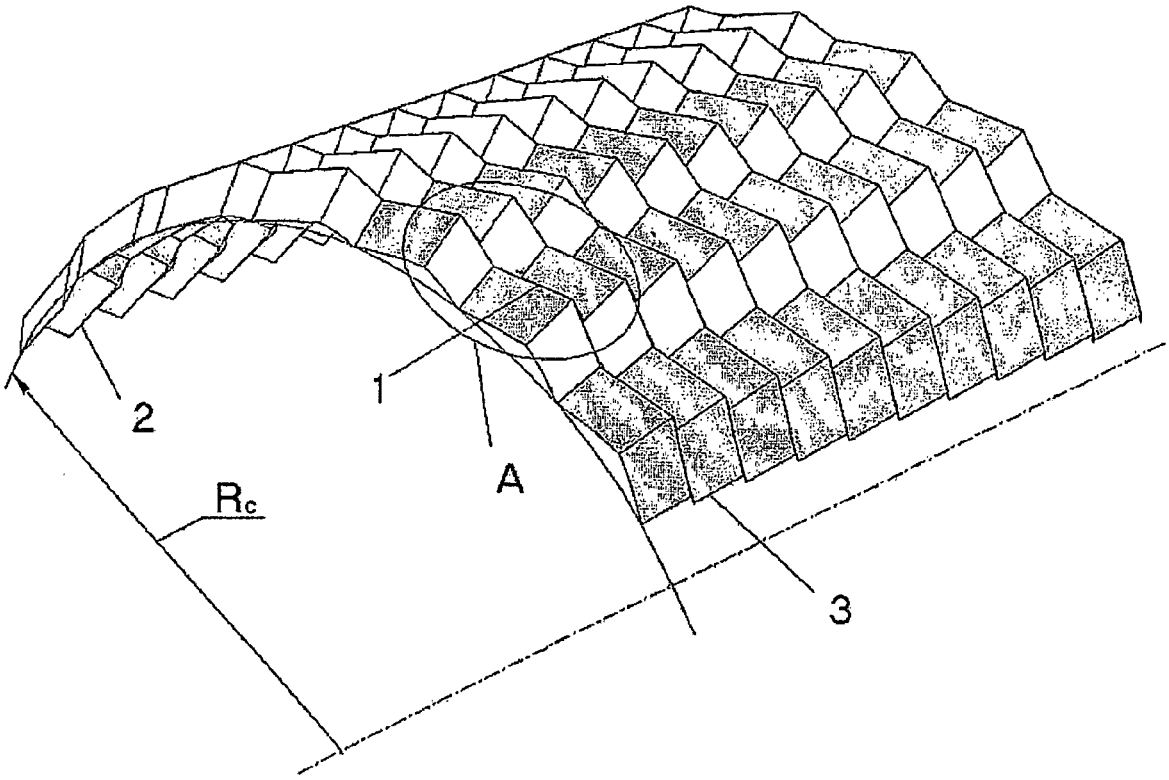
FIGS. 1-5 present the essence of the invention.
Figure 2:
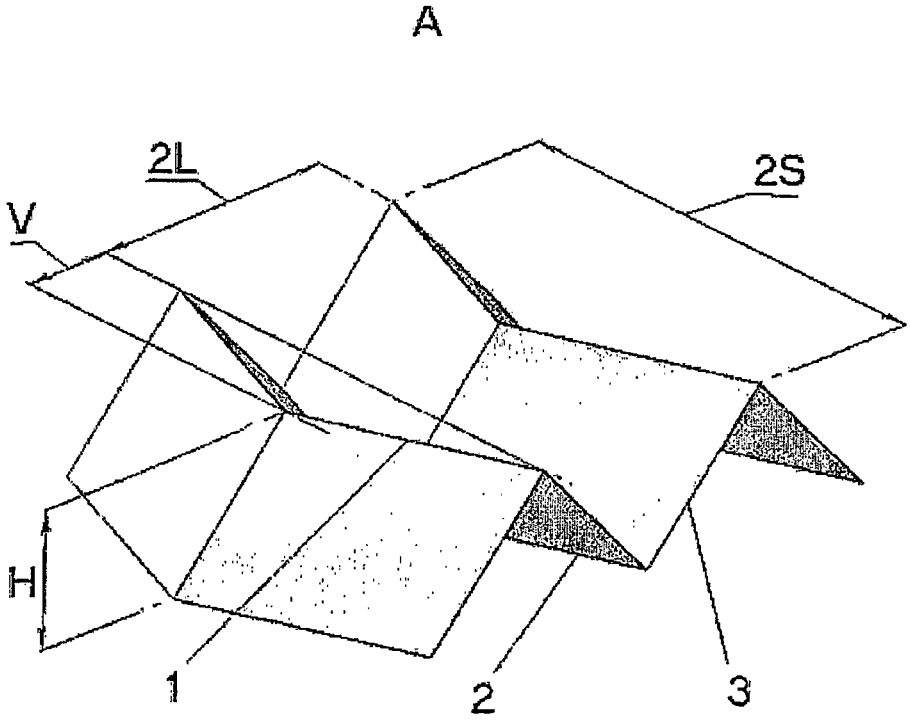
Figure 3:
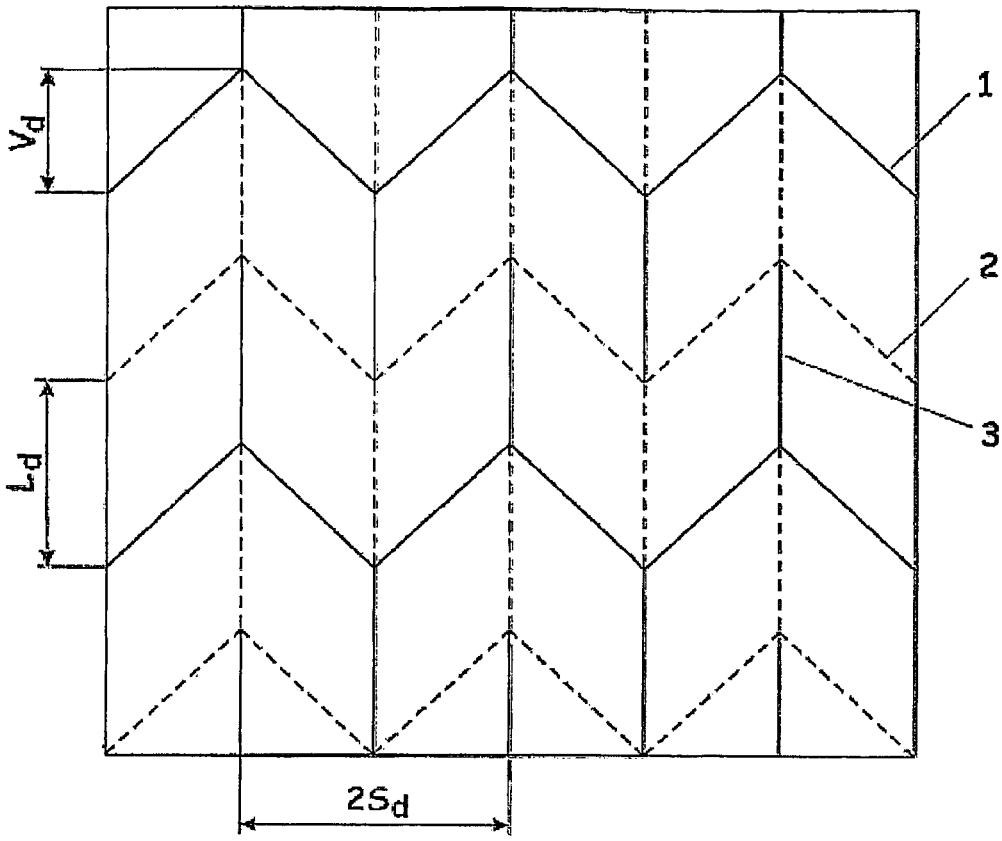
Figure 4:
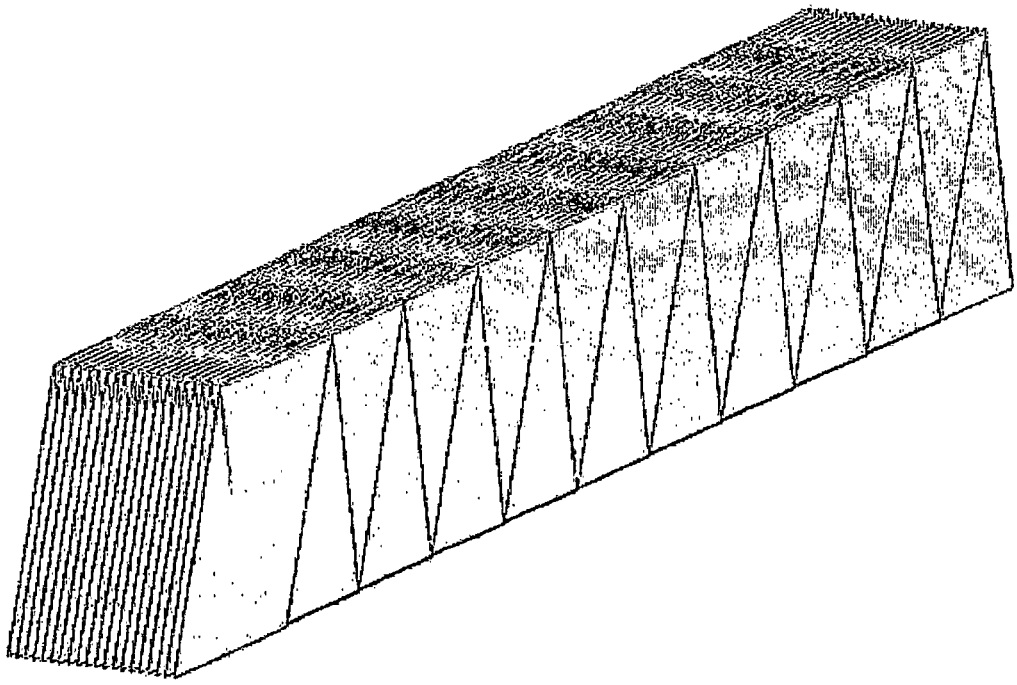

The plane sheet blank (FIG. 3) is bent along the bending lines 1, 2, and 3, and is folded to joining of ridges of the obtained folded structure plane block (FIG. 4). The geometrical parameters of the bending lines 1, 2, and 3 on the folded structure development: $2S_d$ is the step between the zigzag lines, $L_d$ is the distance between the zigzag lines, $V_d$ is the amplitude of the zigzag lines—are related to the crimp design parameters (FIG. 2) of ready-made curvilinear folded structure (FIG. 1): H is the height of zigzag crimp, V is the amplitude of zigzag lines, 2S is the step between zigzag lines, 2L is the step between saw-tooth lines—in the following manner $$L_d = \sqrt{H^2 + L^2},\ V_d = \frac{VL}{\sqrt{H^2 + L^2}},\ S_d = \sqrt{V^2 + S^2 - \frac{V^2 L^2}{H^2 + L^2}}.$$

Figure 5:
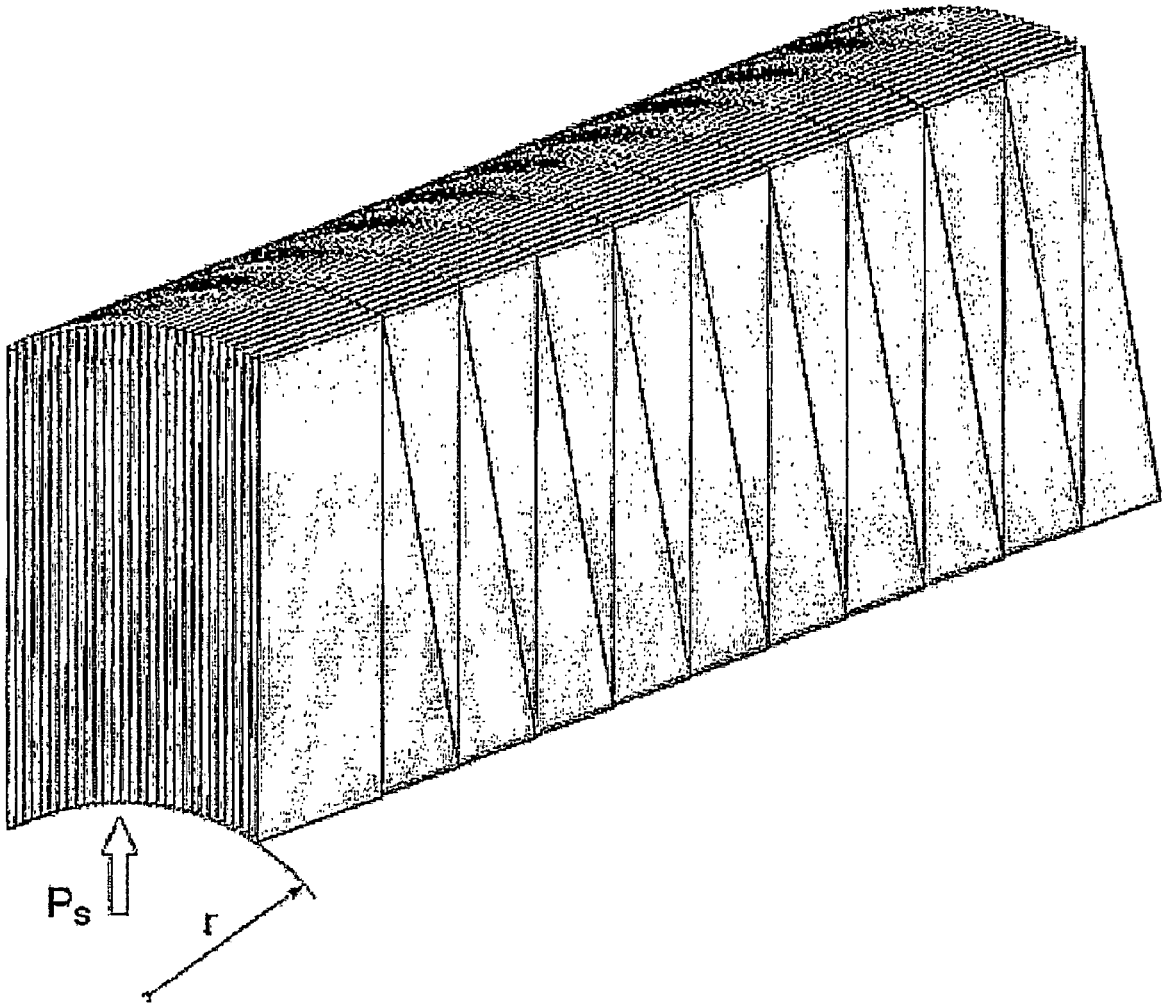

Then, the obtained compressed block is put into the shape of arch by applying shear stresses $P_s$ in the ridges planes (FIG. 5) providing in its lateral section the curvature radius equal to $$r = f(R_c, t, 2S, 2L, V, H),$$

where $R_c$ is the folded structure curvature radius, t is the blank material thickness,

2S, 2L, and H are the folded structure crimp design parameters (see above).

Fixed in such condition block is thermally treated for inner stresses relief in the folded structure material (e.g. for "NOMEX" material the reheat temperature is equal to 180-210° C. and the decay time is equal to 20-30 minutes) whereupon it is stretched to the curvilinear folded structure design parameters given.

INDUSTRIAL APPLICABILITY

The claimed method for curvilinear folded structure core production can be used in industrial production of fuselage panels as applied to passenger airbuses. Created on the basis of the claimed method technology will allow to cut down the expenses on industrial production of passenger aircraft fuselage sandwich panels.

The invention claimed is:

1. A method for producing a curvilinear folded structure comprising the steps of:

bending a sheet blank along bending lines to form a 3-D relief structure;

folding the 3-D relief structure until complete joining of sides of the 3-D relief structure to obtain a folded structure;

applying shear stresses to the folded structure so as to form a folded arched-shaped structure;

thermally treating said folded arched-shaped structure thereby relieving inner stresses in the folded arched-shaped structure; and after said step of thermally treating, stretching said folded arched-shaped structure so as to produce said curvilinear folded structure having an overall curvature radius.

2. The method according to claim 1, wherein said step of thermally treating is performed under a reheat temperature within a range of 180-210° C. and a decay time within a range of 20-30 minutes.

3. The method according to claim 2, further comprising a step of providing aramide NOMEX paper for said sheet blank.

4. The method according to claim 1, wherein said step of applying said shear stresses is performed so as to form said folded arched-shaped structure with a first curvature radius that is a function of said overall curvature radius, and said step of stretching said folded arched-shaped structure is performed by stretching said folded arched-shaped structure from said first curvature radius to said overall curvature radius.

5. The method according to claim 1, wherein the step of bending said sheet blank is performed on the basis of zigzag crimps.

* * * * *